US012259169B2

(12) United States Patent
Kim et al.

(10) Patent No.: US 12,259,169 B2
(45) Date of Patent: Mar. 25, 2025

(54) CLEANING DEVICE OF AUGER-TYPE ICE MAKER AND AUGER-TYPE ICE MAKER INCLUDING THE SAME

(71) Applicant: BLUENIX Co., Ltd., Ansan-si (KR)

(72) Inventors: Doo Ha Kim, Incheon (KR); Seung Jin Shin, Siheung-si (KR)

(73) Assignee: BLUENIX Co., Ltd., Ansan-si (KR)

( * ) Notice: Subject to any disclaimer, the term of this patent is extended or adjusted under 35 U.S.C. 154(b) by 205 days.

(21) Appl. No.: 18/064,259

(22) Filed: Dec. 10, 2022

(65) Prior Publication Data

US 2024/0068727 A1 Feb. 29, 2024

(30) Foreign Application Priority Data

Aug. 26, 2022 (KR) ..... 10-2022-0107585

(51) Int. Cl.
*F25C 1/147* (2018.01)

(52) U.S. Cl.
CPC ..... *F25C 1/147* (2013.01); *F25C 2400/12* (2013.01); *F25C 2400/14* (2013.01); *F25C 2700/04* (2013.01)

(58) Field of Classification Search
CPC ..... F25C 1/147; F25C 1/25; F25C 2400/12; F25C 2400/14; F25C 2700/04; F25C 2600/04; F25C 5/142
See application file for complete search history.

(56) References Cited

U.S. PATENT DOCUMENTS

| | | | | |
|---|---|---|---|---|
| 6,857,284 B1 * | 2/2005 | Brooks | ..... | F25C 1/147 62/303 |
| 2016/0102900 A1 * | 4/2016 | Litchy | ..... | F25C 1/147 62/340 |
| 2021/0222937 A1 * | 7/2021 | Knatt | ..... | F25C 1/25 |

FOREIGN PATENT DOCUMENTS

| | | | | |
|---|---|---|---|---|
| JP | 07020942 A * | 1/1995 | | |
| JP | 2004101108 A * | 4/2004 | | |
| JP | 2021110486 A * | 8/2021 | | |
| KR | 1020170048576 A | 5/2017 | | |
| WO | WO-2013180135 A1 * | 12/2013 | ..... | A61B 90/70 |
| WO | WO-2016057064 A1 * | 4/2016 | ..... | A23G 9/30 |

OTHER PUBLICATIONS

Office Action issued for priority Korean Application No. 10-2022-0107585, mailed Nov. 11, 2024.

* cited by examiner

*Primary Examiner* — Emmanuel E Duke
(74) *Attorney, Agent, or Firm* — Renner, Otto, Boisselle & Sklar, LLP.

(57) ABSTRACT

An auger-type ice maker includes an ice generator including an ice making tube, an auger installed coaxially within the ice making tube, and a refrigerant pipe wound spirally around and fixed to an outer surface of the ice making tube to be in close contact therewith, an ice compressor connected to an upper portion of the ice generator, the ice compressor configured to compress ice generated by the ice generator, and a fluid reservoir connected to a lower portion of the ice generator, the fluid reservoir configured to retain a fluid to be supplied to the ice generator. A portion of the fluid reservoir is disposed in a position the same as or higher than that of the ice compressor.

4 Claims, 6 Drawing Sheets

CLEANING DEVICE OF AUGER-TYPE ICE MAKER AND AUGER-TYPE ICE MAKER INCLUDING THE SAME

CROSS-REFERENCE TO RELATED APPLICATION (S) AND CLAIM OF PRIORITY

This application claims the benefit under 35 USC § 119 of Korean Patent Application No. 10-2022-0107585 filed on Aug. 26, 2022 in the Korean Intellectual Property Office, the disclosure of which is incorporated herein by reference in its entirety.

BACKGROUND

1. Field

The present disclosure relates to a cleaning device of an auger-type ice maker, and an auger-type ice maker including the same.

2. Description of Related Art

As illustrated in FIG. 1A, an auger-type ice maker includes an ice generator 10 including an auger 1, and an ice compressor 20 including an extrusion head 21 disposed on an upper portion of the auger 1. The extrusion head 21 has a cylindrical shape and a series of radially extending bosses forming a channel. The water tank 13 supplies water to a bottom portion of the ice generator 10 and continues to fill water up to an upper portion of the ice generator 10. When the auger 1 is driven, a refrigerant pipe 11 operates to freeze water in an ice making tube. As the auger 1 rotates, the water is frozen to form ice in the form of a slush, the ice is pushed upwards, and the ice pushed upwards from the auger 1 and forcibly moved to the extrusion head 21 is extruded from the ice compressor 20 and upwards by the extrusion head 21.

The interior of the auger-type ice maker needs to be cleaned periodically. If cleaning is not properly performed, scale such as limescale may be generated in the ice generator 10 and the ice compressor 20 in contact with water and ice, or contaminants such as residual chemicals or bacteria may be generated. Accordingly, poor-quality ice may be generated, which may adversely affect working efficiency or result in a reverse load on a motor operating the auger 1, leading to device failure.

Accordingly, in order to clean the auger-type ice maker, a device used for freezing, such as the refrigerant pipe 11, is turned off to melt ice, water in the apparatus is drained through a drain pipe 12. Cleaning liquid is supplied to a water tank 13, and then the auger 1 is operated to clean devices in the ice generator 10.

However, as illustrated in FIG. 1A, a full water level h1 of the water tank 13 reaches only the ice generator 10 and is lower than the ice compressor 20. Accordingly, even when cleaning liquid is injected into the water tank 13, the cleaning liquid may not be supplied up to the ice compressor 20, such that the interior of the ice compressor 20 may not be cleaned.

Accordingly, according to the related art, as illustrated in FIG. 1B, a pipe 22 connected from the water tank 13 to an upper portion of the ice compressor 20 is installed to supply the cleaning liquid, and the cleaning liquid is supplied to an upper portion of the extrusion head 21 of the ice compressor 20 through a valve 23 and a nozzle 24 installed in the pipe 22.

However, to this end, it is necessary to additionally install a cleaning device only for cleaning within the auger-type ice maker. In order to install the pipe 22 connected from the water tank 13 to the upper portion of the ice compressor 20, an additional space is required within the auger-type ice maker, thereby complicating a structure of the auger-type ice maker.

Accordingly, there is a need for the auger-type ice maker capable of cleaning the ice generator 10 and the ice compressor 20 without an additional space or installation of a device.

Related Art 1: U.S. Pat. No. 6,857,284 B1

SUMMARY

An aspect of the present disclosure provides a cleaning device of an auger-type ice maker capable of varying a height of a fluid supplied to an ice generator or an ice compressor in an ice making process and a cleaning process, and an auger-type ice maker including the same.

According to an aspect of the present disclosure, there is provided an auger-type ice maker including an ice generator including an ice making tube, an auger installed coaxially within the ice making tube, and a refrigerant pipe wound spirally around and fixed to an outer surface of the ice making tube to be in close contact therewith, an ice compressor connected to an upper portion of the ice generator, the ice compressor configured to compress ice generated by the ice generator, and a fluid reservoir connected to a lower portion of the ice generator, the fluid reservoir configured to retain a fluid to be supplied to the ice generator. A portion of the fluid reservoir may be disposed in a position the same as or higher than that of the ice compressor.

In addition, the fluid reservoir may include a water tank disposed in a position the same as or higher than that of a connection surface between the ice generator and the ice compressor, and a cleaning tank connected to an upper portion of the water tank through an opening and disposed at the same or a higher position with respect to an upper surface of the ice compressor.

In addition, the water tank may include a storage configured to store ice making water supplied to the ice generator, a water level sensor disposed in the storage, the water level sensor configured to detect a level of the ice making water, and a cover having a first coupler fixing the water level sensor, the cover configured to cover and seal the storage.

The auger-type ice maker may include a controller configured to control driving of the ice generator and the ice compressor. The controller may be configured to drive the ice generator and the ice compressor in an ice making process, and to drive only an auger of the ice generator in a cleaning process after cleaning liquid is poured into the cleaning tank.

The auger-type ice maker may further include a cleaning water level sensor configured to detect a level of water in the cleaning tank.

The controller may be configured to supply ice making water until the water level sensor of the water tank detects a full water level during the ice making process, and to supply the cleaning liquid until the cleaning water level sensor of the cleaning tank detects a full water level during the cleaning process. The ice generator and the fluid reservoir may maintain the same level of ice making water with respect to each other during the ice making process, and the ice compressor and the fluid reservoir may maintain the same level of cleaning liquid with respect to each other during the cleaning process.

In addition, the auger-type ice maker may include a first lever configured to seal a packing, disposed on the first coupler, by rotating the packing, a second lever configured to seal a packing, disposed on a second coupler coupling the storage and the cover to each other, by rotating the packing, and a foreign substance prevention cap configured to cover an upper portion of the cleaning tank.

According to another aspect of the present disclosure, there is provided a cleaning device of an auger-type ice maker, the cleaning device including a water tank including a storage configured to store water supplied to the ice generator and a water level sensor configured to detect a level of water in the storage, and a cleaning tank connected to an upper portion of the water tank through an opening. The water tank may be disposed at the same or a higher height with respect to an upper surface of the ice generator, and the cleaning tank is disposed at the same or a higher height with respect to an upper surface of the ice compressor.

In addition, the water tank may include a cover having a first coupler, fixing the water level sensor, and an opening, the cover configured to cover and seal the storage, a first lever configured to seal the storage by rotating a packing disposed on the first coupler, and a second lever configured to seal the storage by rotating a packing disposed on the second coupler, coupling the storage and the cover portion to each other.

According to an example embodiment of the present disclosure, both an ice making process and a cleaning process may be performed without adding elements such as a pipeline and a valve to the auger-type ice maker, thereby simplifying a structure of a device and reducing costs.

BRIEF DESCRIPTION OF THE DRAWINGS

The above and other aspects, features, and advantages of the present disclosure will be more clearly understood from the following detailed description, taken in conjunction with the accompanying drawings, in which.

DETAILED DESCRIPTION

Figure 1A:
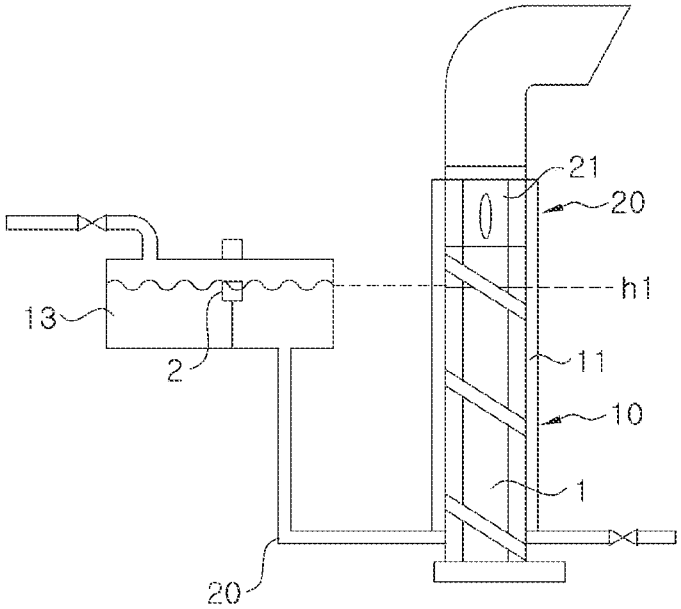
FIG. 1A and FIG. 1B are a side view illustrating a cleaning device of an auger-type ice maker according to the related art.
Figure 1B:
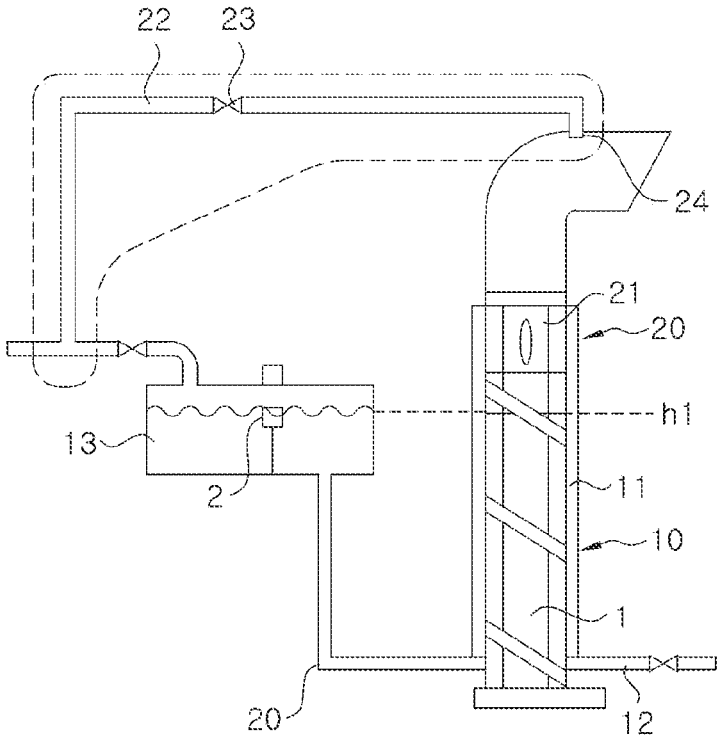

The description of example embodiments is merely a preferable example for the purpose of illustrations only. Various modifications may be made to the example embodiments. Here, the example embodiments are not construed as limited to the disclosure and should be understood to include all changes, equivalents, and replacements within the idea and the technical scope of the disclosure.

Hereinafter, example embodiments will be described in detail with reference to the accompanying drawings. In describing example embodiments, the same names and reference numerals are used for components performing functions the same as those according to the related art.

FIGS. 2 to 5 are diagrams illustrating components of an auger-type ice maker according to an example embodiment of the present disclosure.

The auger-type ice maker according to an example embodiment of the present disclosure may include an ice generator 110 including an ice making tube 112, an auger (not illustrated) installed coaxially within the ice making tube 112, a refrigerant pipe 111 wound spirally around and fixed to an outer surface of the ice making tube 112 to be in close contact therewith, an ice compressor 120 connected to an upper portion of the ice generator 110, the ice compressor 120 compressing ice generated by the ice generator 110, and a fluid reservoir 130 connected to a lower portion of the ice generator 110, the fluid reservoir 130 retaining a fluid to be supplied to the ice generator 110. A portion of the fluid reservoir 130 may be disposed in a position same as or higher than that of the ice compressor 120.

Figure 2:
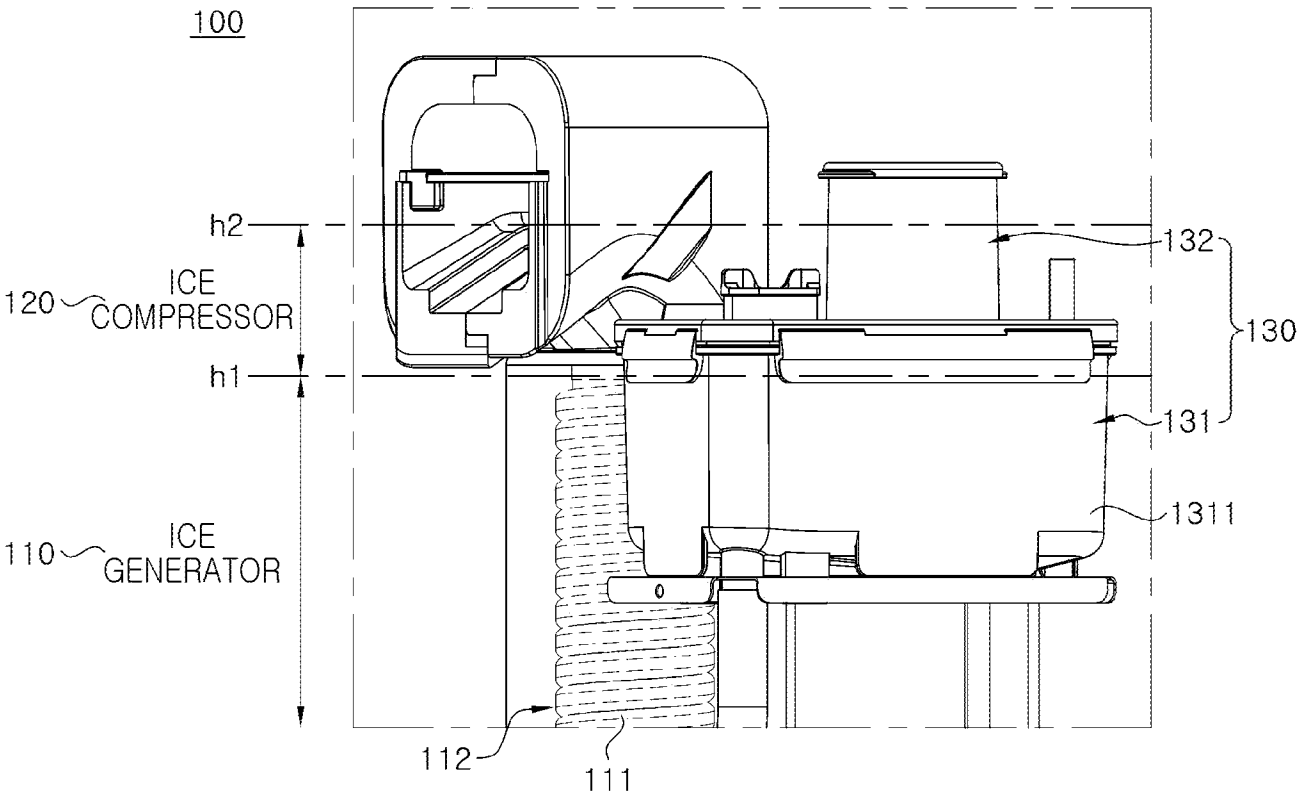
FIG. 2 is a schematic side view illustrating components of an auger-type ice maker in which a cleaning device of the auger-type ice maker according to an example embodiment of the present disclosure is installed.

Although not illustrated in FIG. 2, the auger may be disposed coaxially with the ice making tube 112 within the ice making tube 112, and a motor may be connected to a lower portion of the auger such that the auger rotates.

Accordingly, in an ice making unit of the auger-type ice maker, the auger rotated by a lower motor may be mounted within the vertically installed stainless steel ice making tube 112, and the refrigerant pipe 111 formed in the form of a close contact coil spring may be mounted on an outer periphery of the ice making tube 112.

In addition, in an example embodiment, the fluid reservoir 130 may include a water tank 131 supplying water and a cleaning tank 132 disposed on an upper portion of the water tank 131, the cleaning tank 132 supplying cleaning liquid. The fluid reservoir 130 may be disposed at a height corresponding to those of the ice generator 110 and the ice compressor 120.

In an ice making process, ice making water stored in the water tank 131 may be supplied to the ice making tube 112 to fill the ice making water in the ice making tube 112 up to a full water level h1 of the water tank 131. A refrigerant may be circulated through the refrigerant pipe 111. The auger may be rotated to transfer ice in a slush state generated within the ice making tube 112 to an upper outlet of the ice making tube 112. The ice formed during the ice making operation may be discharged to an ice storage in the form of pieces.

In a cleaning process, cleaning liquid may be supplied to fill both the water tank 131 and the cleaning tank 132, such that the cleaning liquid may be filled in the ice generator 110 and the ice compressor 120 up to a full water level h2 of the cleaning tank 132. A device of freezing ice making water may be turned off, and only the auger may be rotated to clean the interiors of the ice generator 110 and the ice compressor 120.

Specifically, as illustrated in FIG. 2, the fluid reservoir 130 according to an example embodiment of the present disclosure may be connected to the water tank 131 disposed in a position the same as or higher than that of a connection surface (corresponding to a height h1) between the ice generator 110 and the ice compressor 120, and an upper portion of the water tank 131 through an opening 1317 (illustrated in FIG. 3), and may include the cleaning tank 132 disposed at the same or a higher position with respect to an upper surface of the ice compressor 120.

That is, as illustrated in FIG. 2, according to an example embodiment of the present disclosure, the cleaning tank 132 having the full water level h2 the same as or higher than an uppermost end of the ice compressor 120 may be disposed on an upper portion of the water tank 131 having the full water level h1, such that the interior of the ice generator 110 may be filled with the ice making water in the ice making process, and the ice generator 110 and the ice compressor 120 may be filled with the cleaning liquid in the cleaning process.

A full water level of the water tank 131 may be in a position the same as or higher than that of the connection surface (corresponding to the height h1) between the ice generator 110 and the ice compressor 120, and a full water level of the cleaning tank 132 may be at the same or a higher position with respect to the upper surface of the ice compressor 120.

Figure 3:
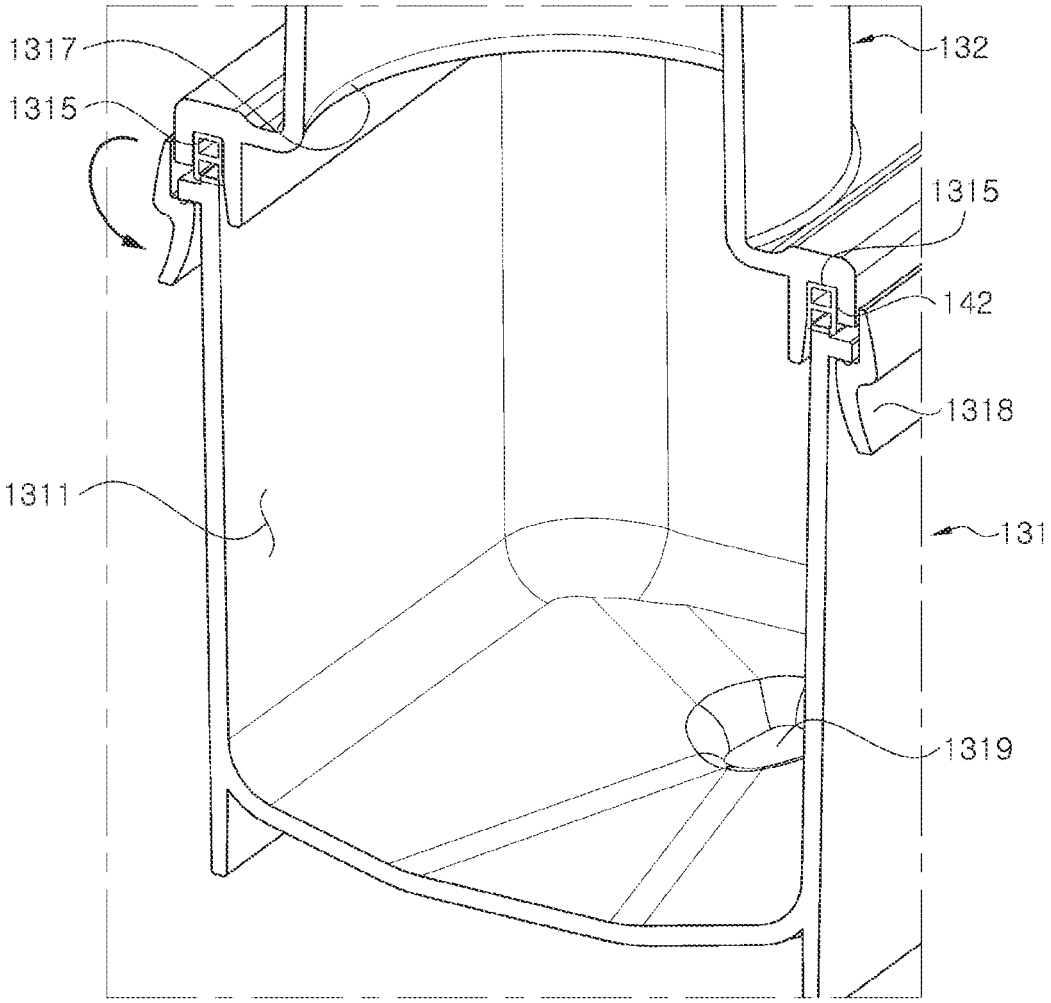
FIG. 3 is a cross-sectional view of a water tank according to an example embodiment of the present disclosure.

As illustrated in FIG. 3, the water tank 131 and the cleaning tank 132 may be connected through the opening 1317, or may be integrally manufactured with the opening 1317 formed therein. A fluid may be supplied to the ice generator 110 through a water supply hole 1319 formed in a lower portion of a storage 1311.

In other words, the auger-type ice maker according to an example embodiment of the present disclosure may include one fluid reservoir 130, and the fluid reservoir 130 may be divided into the water tank 131 and the cleaning tank 132 depending on a relative height difference between the ice generator 110 and the ice compressor 120.

Alternatively, the water tank 131 according to an example embodiment of the present disclosure may include the storage 1311, storing the ice making water supplied to the ice generator 110, and a cover 1314 having a first coupler 141, connected to the water level sensor 1312, the cover 1314 covering and sealing the storage 1311. The cleaning tank 132 having upper and lower perforated portions may be connected to the cover 1314, covering an upper portion of the storage 1311 storing the ice making water.

In this case, according to an example embodiment of the present disclosure, a second lever 1318 sealing a packing 1315, disposed on a second coupler 142 coupling the storage 1311 and the cover 1314, by rotating the packing 1315, and a foreign substance prevention cap 1322 (illustrated in FIG. 5), covering an upper portion of the cleaning tank 132, may be included.

Figure 4:
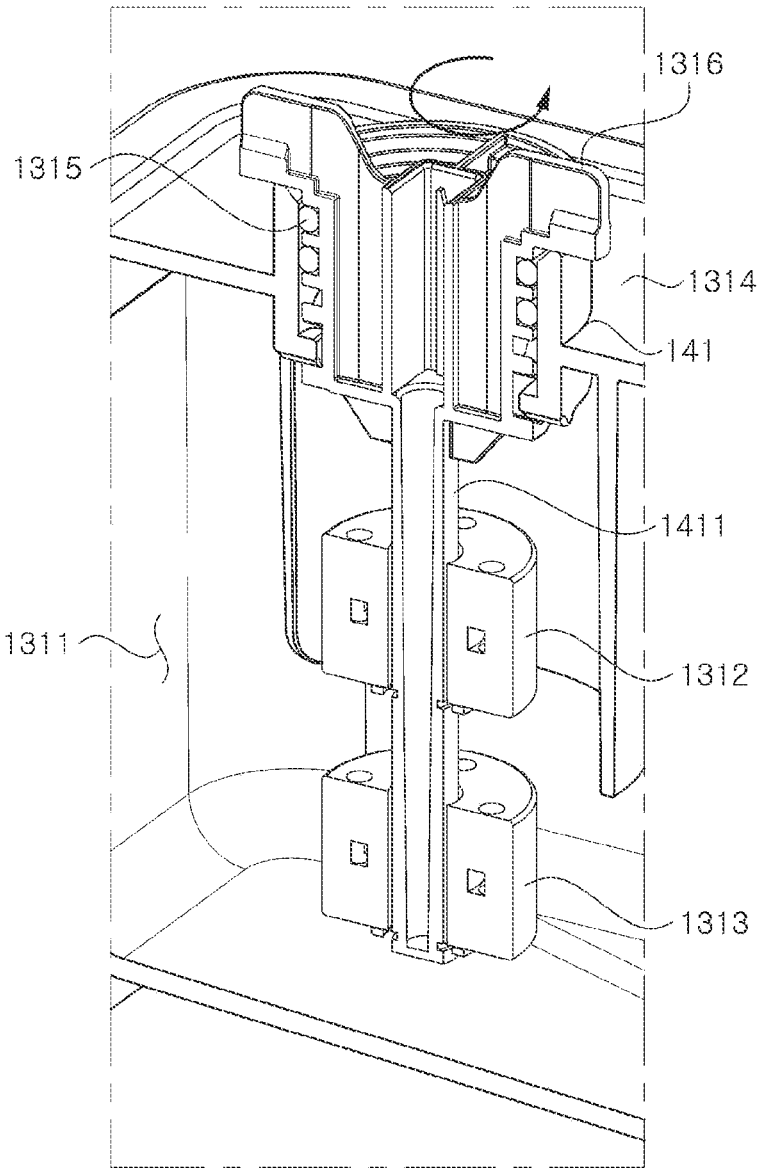
FIG. 4 is a cross-sectional view illustrating a water level sensor of a water tank according to an example embodiment of the present disclosure.

In addition, as illustrated in FIG. 4, the water tank 131 according to an example embodiment of the present disclosure may include the storage 1311, storing the ice making water supplied to the ice generator 110, the water level sensor 1312, disposed within the storage 1311 and detecting a level of the ice making water, and the cover 1314 having the first coupler 141, fixing the water level sensor 1312, the cover 1314 covering and sealing the storage 1311.

The water level sensors 1312 and 1313 may include a water level sensor 1312 detecting whether a water level of the ice making water reaches a full water level, and a water level sensor 1313 detecting whether the water level of the ice making water reaches a minimum water level.

The water level sensor 1312, detecting the full water level, may be connected to a position holder 1411, and an end of the position holder 1411 may be connected to the first lever 1316, such that the water level sensor 1312 may be coupled to the cover 1314 according to rotation of the first lever 1316 to be sealed within the storage 1311.

The first coupler 141 may be formed on the cover 1314 to couple, to each other, the cover 1314 and the position holder 1411 to which the water level sensor 1312 is connected, and the packing 1315 may be disposed on the first coupler 131. The second lever 1316 may be rotated to seal the interior of the storage 1311 using the packing 1315.

That is, as illustrated in FIGS. 3 and 4, according to an example embodiment of the present disclosure, the first lever 1316 sealing a packing, disposed on the first coupler 141, by rotating the packing and the second lever 1318 sealing a packing, disposed on the second coupler 142, by rotating the packing may be included.

Specifically, the water tank 132 may include the storage 1311 and the cover 1314, and the packing 1315 may be disposed between the storage 1311 and the cover 1314 to form a sealed structure. A structure capable of filling the cleaning liquid up to the ice compressor 120, all of the cleaning liquid may leak between the storage 1311 and the cover 1314. Accordingly, in order to prevent the cleaning liquid from leaking when the cleaning liquid is supplied beyond the cover 1314, the second lever 1318 may be rotated as illustrated in FIG. 3, such that the packing 1315 may be fixed to the second coupler 142 to form a sealed structure, and the second lever 1318 may be rotated in an opposite direction to separate the packing 1315 from the second coupler 142, such that the storage 1311 and the cover 1314 may be separated from each other.

In addition, the first lever 1316, capable of attaching and detaching the packing 1315 to the first coupler 141 coupling, to each other, the cover 1314 and the position holder 1411 to which the water level sensor 1312 is connected, may be disposed. In addition, when the first lever 1316 is rotated in the direction illustrated in FIG. 4, the first lever 1316, to which the water level sensors 1312 and 1313 are connected, may bring the packing 1315 into close contact with the first coupler 141 to form a sealed structure. When the first lever 1316 is rotated in an opposite direction thereof, the packing 1315 may be separated from the first coupler 141 to separate the water level sensors 1312 and 1313 and the cover 1314 from each other.

When the cleaning liquid is injected in excess of a full water level of the water tank 132, a sealed structure may be applied to all connection structures, thereby preventing water leakage.

Figure 5:
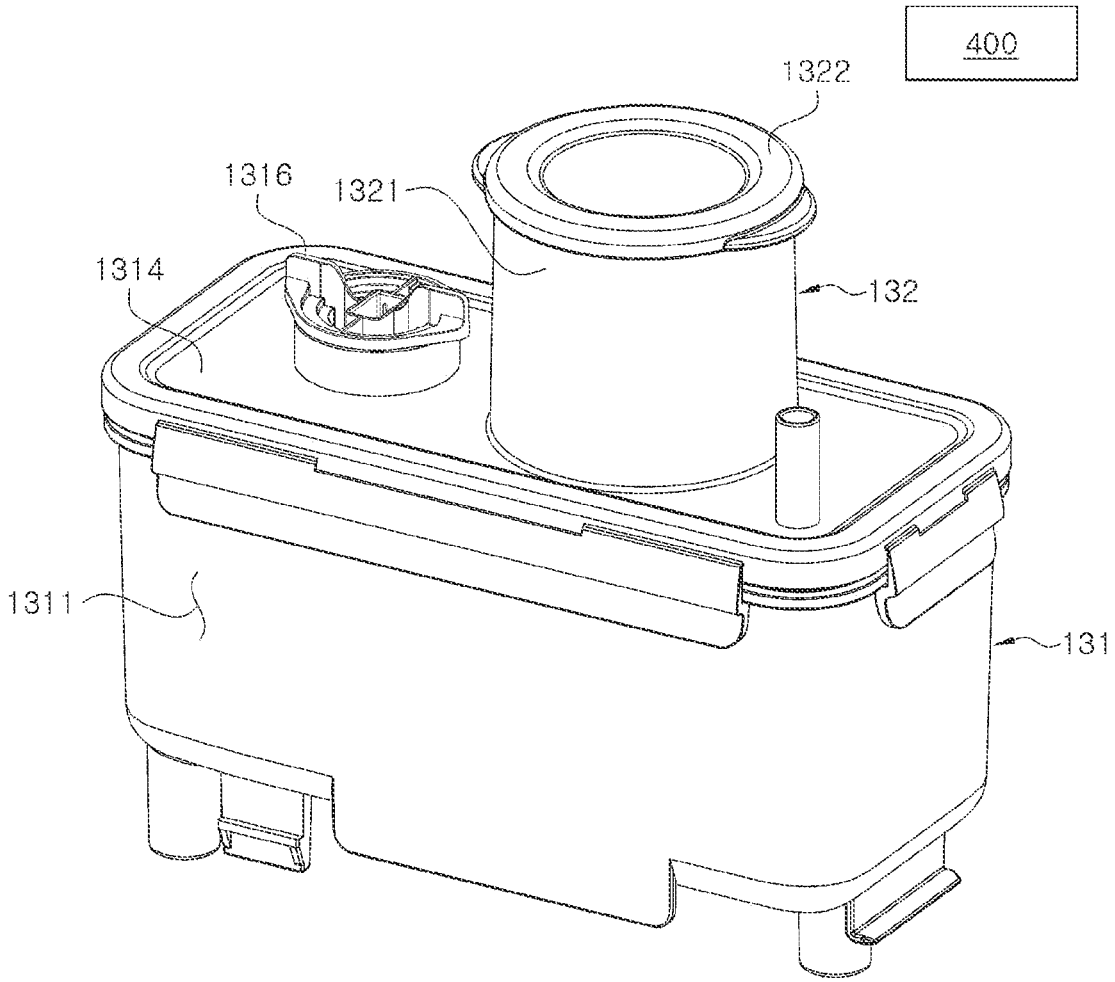
FIG. 5 is a perspective view illustrating a water tank and a cleaning tank according to an example embodiment of the present disclosure.

As illustrated in FIG. 5, the auger-type ice maker according to an example embodiment of the present disclosure may include a controller 400, controlling driving of the ice generator 110 and the ice compressor 120. The controller 400 may drive the ice generator 110 and the ice compressor 120 in the ice making process, and may drive only the auger of the ice generator 110 in the cleaning process after the cleaning liquid is poured into the cleaning tank 132.

In this case, according to an example embodiment of the present disclosure, a cleaning water level sensor, detecting a water level of the cleaning tank 132, may be further included.

According to an example embodiment of the present disclosure, the ice making water may be supplied until the water level sensor 1312 of the water tank 131 detects a full water level during the ice making process, and the cleaning liquid may be supplied until the cleaning water level sensor of the cleaning tank 132 detects a full water level during the cleaning process. The ice generator 110 and the fluid reservoir 130 may maintain the same level of ice making water level with respect to each other during the ice making process, and the ice compressor 120 and the fluid reservoir 130 may maintain the same level of cleaning liquid with respect to each other during the cleaning process.

According to another example embodiment, when the cleaning liquid is supplied in the cleaning process, the entire fluid reservoir 130 may be filled by filling the cleaning tank 132 without the cleaning water level sensor.

Accordingly, the cleaning device of the auger-type ice maker according to an example embodiment of the present disclosure may include the reservoir 1311 storing water supplied to the ice generator 110, the water tank 131 including the water level sensor 1312 detecting a level of water in the reservoir 1311, and the cleaning tank 132 connected to an upper portion of the water tank 131 through the opening 1317. The water tank 131 may be disposed at the same or a higher position with respect to an upper surface of the ice generator 110, and the cleaning tank 132 may be disposed at the same or a higher position with respect to an upper surface of the ice compressor 120.

In addition, according to an example embodiment of the present disclosure, the water tank 131 may include the cover 1314, having the opening 1317 and covering and sealing the storage 1311, the second lever 1318, rotating and sealing the packing 1315 disposed on the second coupler 142 coupling the storage 1311 and the cover 1314 to each other, and the first lever 1316, rotating and sealing the packing 1315 disposed on the first coupler 141. The cleaning tank 132 may include the foreign substance prevention cap 1322 covering an upper portion of the cleaning tank 132.

In other words, the water tank 131 may include the first coupler 141, fixing the water level sensors 1312 and 1313, and the cover 1314 having the opening 1317, and may include the first lever 1316 or the second lever 1318, sealing the cover 1314 or the water level sensors 1312 and 1313 to the storage 1311.

While example embodiments have been illustrated and described above, it will be apparent to those skilled in the art that modifications and variations could be made without departing from the scope of the present disclosure as defined by the appended claims.

What is claimed is:

1. An auger-type ice maker comprising:

an ice generator including an ice making tube, an auger installed coaxially within the ice making tube, and a refrigerant pipe wound spirally around and fixed to an outer surface of the ice making tube to be in close contact therewith;

an ice compressor connected to an upper portion of the ice generator, the ice compressor configured to compress ice generated by the ice generator; and a fluid reservoir connected to a lower portion of the ice generator, the fluid reservoir configured to retain a fluid to be supplied to the ice generator, wherein the fluid reservoir includes a water tank disposed in a position the same as or higher than that of a connection surface between the ice generator and the ice compressor; and a cleaning tank connected to an upper portion of the water tank through an opening and disposed at the same or a higher position with respect to an upper surface of the ice compressor, wherein the water tank includes a storage configured to store ice making water supplied to the ice generator; a water level sensor disposed in the storage, the water level sensor configured to detect a level of the ice making water; a cover having a first coupler fixing the water level sensor, the cover configured to cover and seal the storage, wherein the cover comprises a first lever configured to seal a packing, disposed on the first coupler, by rotating the packing and a second lever configured to seal a packing, disposed on a second coupler coupling the storage and the cover to each other, by rotating the packing.

2. The auger-type ice maker of claim 1, wherein the water tank further comprises:

a foreign substance prevention cap configured to cover an upper portion of the cleaning tank, and wherein when viewed from above, the cleaning tank is positioned inside the cover at a location different from the first lever.

3. A cleaning device of an auger-type ice maker, the cleaning device comprising:

a water tank including a storage configured to store water supplied to an ice generator, a water level sensor configured to detect a level of water in the storage and a cover which is configured to cover and seal the storage and comprises an opening connected to a cleaning tank; and the cleaning tank connected to an upper portion of the cover of the water tank through an opening, wherein the water tank extends upward from the cover so that the water tank is disposed at the same or a higher height with respect to an upper surface of the ice generator, and the cleaning tank is disposed at the same or a higher height with respect to an upper surface of an ice compressor connected to an upper portion of the ice generator, wherein the cover further comprises a first coupler, fixing the water level sensor; a first lever configured to seal the storage by rotating a packing disposed on the first coupler; and a second lever configured to seal the storage by rotating a packing disposed on the second coupler, coupling the storage and the cover portion to each other.

4. The cleaning device of claim 3, wherein the cleaning tank includes a foreign substance prevention cap configured to cover an upper portion of the cleaning tank and wherein when viewed from above, the cleaning tank is positioned inside the cover at a location different from the first lever.

* * * * *